United States Patent [19]

Yamazaki et al.

[11] Patent Number: 4,613,377

[45] Date of Patent: Sep. 23, 1986

[54] PRODUCTION OF FRUCTOSE SYRUP

[76] Inventors: Hiroshi Yamazaki, 22 Alderbrook Dr., Nepean, Ontario K2H 5W5; Kouchi Matsumoto, 260 Cummings Ave. #3, Ottawa, Ontario, both of Canada

[21] Appl. No.: 674,136

[22] Filed: Nov. 23, 1984

[30] Foreign Application Priority Data

Jul. 24, 1984 [CA] Canada ..... 459547

[51] Int. Cl.[4] ..... C13D 3/14

[52] U.S. Cl. ..... 127/39; 127/46.2; 127/55; 127/69

[58] Field of Search ..... 127/30, 40, 46.2, 55, 127/39, 65–70

[56] References Cited

U.S. PATENT DOCUMENTS

| | | | |
|---|---|---|---|
| Re. 28,885 | 6/1976 | Cotter et al. | 195/31 |
| 2,567,060 | 9/1951 | Docal | 127/53 |
| 2,746,889 | 5/1956 | Langlois et al. | 127/36 |
| 2,950,228 | 8/1960 | Marshall | 195/66 |
| 3,044,904 | 7/1962 | Serbia | 127/46 |
| 3,285,776 | 11/1966 | Scallet et al. | 127/30 |
| 4,421,852 | 12/1983 | Hoehn et al. | 127/30 |

FOREIGN PATENT DOCUMENTS

| | | |
|---|---|---|
| 488176 | 11/1952 | Canada . |
| 525394 | 5/1956 | Canada . |
| 694539 | 9/1964 | Canada . |
| 756575 | 4/1967 | Canada . |
| 771127 | 11/1967 | Canada . |
| 813297 | 5/1969 | Canada . |
| 868346 | 4/1971 | Canada . |
| 877950 | 8/1971 | Canada . |
| 898246 | 4/1972 | Canada . |
| 918150 | 1/1973 | Canada . |
| 947217 | 5/1974 | Canada . |
| 963899 | 3/1975 | Canada . |
| 986866 | 4/1976 | Canada . |
| 1117047 | 1/1982 | Canada . |
| 1146102 | 5/1983 | Canada . |
| 1156951 | 11/1983 | Canada . |
| 2160919 | 12/1971 | Fed. Rep. of Germany . |
| 1103394 | 12/1968 | United Kingdom . |

*Primary Examiner*—Ivars Cintins

*Attorney, Agent, or Firm*—Steele, Gould & Fried

[57] ABSTRACT

Novel, highly useful, sweet fructose-containing syrups also containing fructooligosaccharides are provided herein by the partial or substantially complete hydrolysis of inulin. The process includes first providing an aqueous solution containing inulin from Jerusalem artichoke tubers or chicory roots. Then the warm aqueous solution of inulin is passed through a column containing a strong acid cation-exchange resin, thereby providing an effluent having a pH of about 2.0–about 3.0. The effluent is then hydrolyzed by heating at a temperature of about 70°–about 100° C., and the hydrolyzate is passed through a column containing of about 6.5–about 7.0. resin, thereby providing an effluent having a pH about 6.5–about 7.0. Optionally, after the hydrolysis step, the hydrolyzate is decolorized by contact with activated or granular charcoal. The effluent is then concentrated to a syrup containing less water than the effluent, e.g. one containing about 40–about 70% solids. The sweet fructose syrup containing oligofructans can be used as truly "health" sweetener, particularly ideal for elderly people and diabetics. The pulp obtained after the juice extraction is rich in protein and can be used as feed.

19 Claims, 4 Drawing Figures

C-RIA
SMPL# 00
FILE # 7
REPT# 2281
METHOD 41

| # | NAME | TIME | CONC | MK | AREA |
|---|---|---|---|---|---|
| 0 | | 4.1 | 41.4303 | | 124375 |
| 0 | | 5.42 | 10.1179 | | 30374 |
| 0 | | 5.89 | 2.6938 | V | 8086 |
| 0 | | 6.85 | 28.3751 | V | 85182 |
| 0 | | 9.45 | 7.6684 | | 23020 |
| 0 | | 12.35 | 5.4911 | | 16484 |
| 0 | | 16.35 | 4.2231 | | 12677 |
| | TOTAL | | 100 | | 300202 |

C-RIA
SMPL# 00
FILE # 7
REPT# 2281
METHOD 41

| # | NAME | TIME | CONC | MK | AREA |
|---|---|---|---|---|---|
| 0 | | 4.1 | 41.4303 | | 124375 |
| 0 | | 5.42 | 10.1179 | | 30374 |
| 0 | | 5.89 | 2.6938 | V | 8086 |
| 0 | | 6.85 | 28.3751 | V | 85182 |
| 0 | | 9.45 | 7.6684 | | 23020 |
| 0 | | 12.35 | 5.4911 | | 16484 |
| 0 | | 16.35 | 4.2231 | | 12677 |
| | TOTAL | | 100 | | 300202 |

C-RIA
SMPL# 00
FILE # 7 G
REPT# 2280
METHOD 41

| # | NAME | TIME | CONC | MK | AREA |
|---|---|---|---|---|---|
| 0 | | 4.11 | 41.1759 | | 131349 |
| 0 | | 5.43 | 15.7502 | V | 49051 |
| 0 | | 5.91 | 4.2441 | V | 13217 |
| 0 | | 6.88 | 24.7 | V | 76923 |
| 0 | | 9.46 | 5.6298 | V | 17533 |
| 0 | | 12.4 | 4.4627 | | 13898 |
| 0 | | 16.36 | 3.0371 | | 9458 |
| | TOTAL | | 99.9999 | | 311431 |

C-R1A
SMPL # 00
FILE # 7
REPT # 2275
METHOD 41

| # | NAME | TIME | CONC | MK | AREA |
|---|---|---|---|---|---|
| 0 | | 4.12 | 39.7313 | | 119385 |
| 0 | | 5.45 | 27.4245 | V | 82405 |

C-R1A
SMPL # 00
FILE # 7
REPT # 2276
METHOD 41

| # | NAME | TIME | CONC | MK | AREA |
|---|---|---|---|---|---|
| 0 | | 4.11 | 40.1138 | | 137677 |
| 0 | | 5.42 | 38.8899 | V | 133477 |
| 0 | | 5.92 | 13.6444 | V | 46830 |
| 0 | | 6.92 | 7.3517 | V | 25232 |
| | TOTAL | | 99.9999 | | 343217 |

PRODUCTION OF FRUCTOSE SYRUP

BACKGROUND OF THE INVENTION (i) Field of the Invention

This invention relates to a process for the preparation of oligofructans and to the mixture of such oligofructans (i.e. the fructose syrup) so produced.

(ii) Description of the Prior Art

Starch conversion syrups are conventionally produced by the hydrolysis of starch. These starch conversion syrups, e.g. corn syrup, consist primarily of D-glucose, maltose, a small amount of oligoglucans and dextrins. The amounts of these primary constituents, of course, vary from one syrup to another depending upon a number of different factors. The isomer of glucose known as fructose may be formed by the interconversion, i.e. isomerization, of glucose.

It is also known that when a syrup containing sucrose is hydrolyzed, equal parts of fructose and glucose are formed and the product is known as "invert syrup". Sucrose is deliberately converted to invert sugar in the manufacture of certain non-crystallizing syrups, e.g. golden syrup and treacle.

Fructose is also widely distrubuted in nature. Fructose occurs in both furanose and pyranose forms. An aqueous solution at 20° contains about 20% of the furanose form:

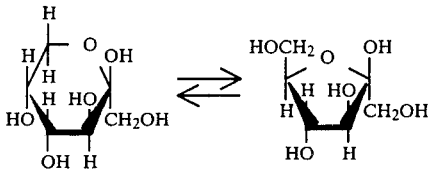

It is well known that crystalline fructose is 1.8 times sweeter than sucrose (See, e.g. Shallenberger et al, SUGAR CHEMISTRY, page 116 (1983), the AVI Publishing Company, Inc.) Thus, fructose is fast becoming one of the most popular candidates for sweetening foods and beverages, since its greater sweetening power makes possible a significance reduction in the caloric intake of the food or beverage consumer. Moreover, fructose is preferred to sucrose (cane sugar) in the food industry because it crystallizes less rapidly than sucrose (thus giving a smoother texture). Since its metabolism in humans does not depend on insulin, diabetics can use fructose as a sweetener.

In recent years, a number of synthetic sweeteners have come under close scrutiny as a result of experiments indicating carcinogenic activity in experimental animals; hence, the purely "natural" route to lower caloric intake offered by fructose sweetening has acquired even greater significance.

While sucrose and glucose are produced on a large scale for use in high energy foodstuffs and a great number of technical products, the commercial use of fructose has been very limited up to date, since it has been available mostly as low fructose-content sugars. In many aspects of the industrial practice of manufacturing pharmaceuticals, foods, beverages, dietary supplements, and the like, those various relatively low fructose-content sugars (typically about 42 to about 55% fructose) are not preferred. One somewhat more preferred form would be "high fructose syrup", i.e. a relatively concentrated aqueous solution of substantially pure fructose or fructose mixed with minor amounts of other carbohydrates, which can, if desired, be crystallized directly to obtain substantially pure crystalline fructose.

Another commercial potential of fructose is related to the fact that fructose may be readily converted to mannitol. In the present method of manufacturing mannitol from invert syrup, for every 1 part molar of mannitol produced 3 parts molar of sorbitol are also obtained as a byproduct. On the other hand, a pure fructose syrup yields only 1 part molar of sorbitol for every part molar of mannitol.

In the prior art attempts have been made to utilize the interconversion reaction referred to above to produce syrups sweeter than conventional starch conversion syrups. Various processes for achieving this interconversion have been described in the literature.

The isomerization of D-glucose, D-mannose, and D-fructose by the action of aqueous alkali has long been known. This isomerization reaction is conventionally referred to as the "Lobry de Bruyn-van Ekenstein Conversion" after its discoverers (Rec. trav. chim. Pays-Bas 14.203/1895 and 15.92/1896). It has been found that D-glucose can be isomerized using various catalysts, e.g. sodium hydroxide, sodium carbonate, calcium hydroxide, alkaline earth carbonates, alkaline ion exchangers, ammonia, or pyridine. However, the amounts of D-fructose thereby formed amounted to a maximum of about 10–about 30%, the yields of actually isolated fructose being still lower as the isolation of the fructose from the reaction mixture could be performed only with great difficulty and with considerable losses.

It has been proposed to increase the yields of D-fructose obtained by the alkaline isomerization of D-glucose by working in the presence of borates (Mendicino, J. Am. Chem. Soc. 82.4975/1960). However, this process cannot be used industrially for the production of D-fructose since its isolation from the reaction mixture is practically impossible.

There are many patents in existence directed to attempts to improve the process discovered by Lobry de Bruyn and W. A. van Ekenstein so that such process could be exploited industrially for the manufacture of fructose.

For example, Canadian Pat. No. 488,178 issued Nov. 18, 1952 to Corn Products Refining Company is related to the production of a levulose-containing syrup by the interconversion of dextrose, under the influence of an alkaline catalyst under controlled conditions. In an attempt to overcome the presence of various objectionable substances present in a syrup so produced, namely mannose, a group of non-fermentable sugars known as "glutose", saccharinic acids, colloidal materials, various metallic salts, hydroxymethylglyoxan and methylglyoxal, which imparted an undesirable color and unpleasant taste to the syrup, the patentee added an additional step. The patented process involved the step, with or without removal of the alkaline catalyst, of treating the resultant liquor with a hydrogen base exchanger and acid absorbent resins to remove therefrom various objectionable substances, notably methylglyoxal and hydroxymethylglyoxal.

Canadian Pat. No. 694,539 issued Sept. 15, 1964 to C. F. Boehringer & Soehne, taught that D-fructose could be readily prepared in excellent yields if the isomerization of D-glucose by the action of aqueous alkali is carried out using an alkali metal aluminate, e.g. sodium aluminate or potassium aluminate. When the isomerization was completed, the aluminum was precipitated in the form of its hydroxide and was removed. The D-fructose could then be isolated as calcium fructosates. The D-fructose could be liberated from the fructosate with carbonic acid, followed by the removal of the water by distillation, and recrystallation out of methanol.

Canadian Pat. No. 868,346 issued Apr. 13, 1971 to Laevosan provided a process for the production of fructose and glucose from sucrose. According to that patented process, sucrose was first inverted under mild conditions and the pure invert sugar solution was evaporated under mild conditions. The invert sugar concentrate obtained was treated, preferably after separation from crystallized glucose, with a lower alcohol, e.g. methanol, and the two sugars were crystallized alternately after inoculation with substantially complete separation of the crystals from each other.

Canadian Pat. No. 898,246 issued Apr. 18, 1972 to Ryoki Tatuki, et al, provided a method for separating fructose advantageously from a sugar solution mixed along with glucose, e.g. fructose from the invert sugar solution of sugar, from the isomerized sugar solution obtained by isomerizing glucose at high yield. The patented method involved adding calcium chloride to that sugar solution in the neutral or acidic region, to dissolve calcium chloride therein, condensing the thus obtained mixture solution, forming fructose calcium chloride double salt by slowly cooling that solution while slowly stirring the same, and separating fructose from the double salt. Glucose contained in the thus obtained residual liquid could be recovered by subjecting the raw material sugar solution as the condensing liquor to electrodialysis.

Canadian Pat. No. 1,146,102 issued May 10, 1983 to American Crystal Sugar Company provided a process for obtaining fructose from a fructofuranoside-containing starting material (e.g. a material containing saccharides of the fructofuranoside type), which involved the following steps: (a) hydrolyzing the saccharide to provide a mixture of glucose and fructose; (b) adding a basic calcium compound to precipitate a mixture of calcium-sugar complexes which will comprise primarily the calcium-fructose complex; (c) treating the calcium-fructose complex thereby obtained with phosphoric acid in an aqueous reaction medium under temperature conditions sufficiently cool to provide a high quality product in high yield; and (d) recovering fructose of relatively high purity is from this reaction medium.

Another technique for the preparation of fructose involved chemical precipitation of fructose to separate the products of the inversion reaction. This technique took advantage of the fact that fructsate complexes were less soluble in water than, for example, the corresponding glucosates.

At first glance, such chemical precipitation techniques (whereby alkaline earth metal cations form complexes with the sugars in the sugar mixture) would appear to be very promising. Hydrolysis of the sucrose molecule provided an equimolar mixture of glucose and fructose. Significant progress in the utilization of the chemical precipitation technique for separating fructose from glucose was, however, hindered by the stability of the alkaline earth metal fructose complex under cold conditions. Various acids were found to break up this complex and release the fructose, the most common of these being carbonic acid. Carbon dioxide as carbonic acid caused a precipitation of calcium carbonate and released fructose to the aqueous medium. The calcium carbonate precipitate could then be removed by filtration.

The conventional process is thus based on the precipitation of calcium fructosate by the addition of calcium hydroxide to the invert sugar solution. The highly insoluble frutosate is separated, then split with acids, mostly carbonic acid, and after concentration of the diluted frutose solution obtained, crystallized from methanol.

The results of such carbonic acid precipitation technique have apparently not met modern industry standards for the production of relatively pure fructose for a number of reasons. For example, even at low temperature, a considerable amount of color bodies tended to form prior to or during or even subsequent to the liberation of the fructose from the fructosate complex, due to the destruction of the fructose molecule. In many large scale uses of fructose, a clear solution or a pure white powder or crystal was desirable or even essential for consumer acceptance or for satisfying industry-imposed quality control standards. Consequently, these color bodies must be removed, or their formation avoided.

Patents have issued directed to the separation of the products of sucrose inversion by the formation of a sparingly-soluble salt with an alkaline earth metal hydroxide, e.g. calcium, strontium or barium hydroxide, separation of the precipitate and regeneration thereof to give a sugar solution. The precipitation process with alkaline earth metal hydroxides required a large amount of the hydroxides and, subsequently, a large amount of precipitating agent, for example, carbon dioxide, sulphuric acid or phosphoric acid for the metals. Even when, for example, the precipitated alkaline earth metal carbonates could be regenerated by calcination, a considerable expenditure on auxiliary chemicals and treatment costs was necessary. Furthermore, the sugar solutions obtained were adulterated with impurities, especially ions of the alkaline earth metal used, and must be freed from these, for example, by ion exchangers. However, the ion exchangers, in the acidic form, had a hydrolytic action upon sucrose and, in the alkaline form, caused discolouration.

Other patents teach the use of the easy oxidizability of glucose to gluconic acid by means of bromine or iodine to separate it from the fructose. The gluconic acid is separated off as a sodium or calcium salt which is highly insoluble in methanol, or removed by anion exchangers and the fructose is obtained as above from the remaining solution. Only the electrolytic variant of this principal is technically important due to the high price of the halogens and the high salt loading (see Sugar Research) Foundation, U.S. patent specification No. 2,567,060).

Other patents have issued directed to the separation of the products of sucrose inversion by a suitable pretreatment, for example, with sulphuric acid in an organic solvent, e.g. methanol or ethanol, after which a part of the sucrose can be crystallized from the organic solvent. For example, fructose may be separated from an alcohol solution in the form of its calcium chloride double salt. It was necessary to use a large amount of alcohol and to keep the concentration of alcohol constant in view of the separation of fructose. Moreover, it was necessary to provide equipment for recovering the used alcohol.

In such conventional method in which alcohol solution was used, it was also necessary, in order to separate fructose from the fructose calcium chloride double salt, to add a precipitant for producing the insoluble salt of calcium, e.g. carbonate, sulfate, or oxalate. Then, it was necessary to desalt. Since the amount of calcium chloride contained therein was relatively large, this was not economically viable. In addition, in such method, the loss of fructose was large. It was also known in principle to affect a separation of fructose and glucose by bringing their aqueous solution into contact with an ion exchange resin. One such ion exchange resin was a calcium sulphonated polystyrene cation exchange resin. Fructose was preferentially absorbed by the resin and glucose preferentially remained in the surrounding aqueous liquid. The fructose was subsequently washed out of the resin after displacing the surrounding glucose-enriched solution.

Sucrose could also be hydrolyzed with cationic exchange resins in the H-form, but in such case a complete hydrolysis was only possible with very long residence times of the sucrose in the exchanger. It was further known that invert sugar solutions on exchangers in the pure H-form suffered undesirable discoloration at elevated temperatures and comparatively long residence times. The same thing happened with glucose and fructose solutions which had been produced by inversion with mineral acids and subsequently passed over a basic exchanger for the purpose of removing acid ions.

In another use of ion exchange resins, prior to isomerization glucose-containing liquors were refined by conventional means, e.g., by treating the liquors with carbon and ion exchange materials.

Among the patents directed to such procedures are:

German Pat. No. 2,160,919 to Takasaki taught process for the separation of a mixture of carbohydrates by treating the mixture with an anion exchanger in the sulfite or bisulfite form.

Canadian Pat. No. 525,394 issued May 24, 1966 to American Cyanamid Company provided a procedure for the clarification of aqueous solutions containing a sugar. The invention involved passing an aqueous solution of a sugar through a bed of an anion active resin, and thereafter heating the juice to precipitate insoluble calcium and magnesium salts together with colloidal materials, clarifying or filtering the juice optionally crystallizing sugar therefrom.

Canadian Pat. No. 756,575 issued Apr. 11, 1967 to the Colonial Sugar Refining Company Limited provided a process for the separation of fructose and glucose from syrups containing them, involving a complicated series of recycling steps based upon a first step of sequentially admitting predetermined volumes of the syrup and water to a column charged with a water-immersed bed of an alkaline earth metal salt of a cross-linked cation exchange resin, then separating that effluent into six fractions, then sequentially admitting only two of such fractions along with water and the syrup being separated.

Canadian Pat. No. 1,156,951 issued Nov. 15, 1983 to Nabisco Inc. provided a process for isomerizing glucose in a glucose-containing liquor to fructose, by first treating a glucose-containing liquor with an ion exchange material and then contacting the treated liquor with immobilized glucose isomerase to convert a portion of the glucose to fructose. The glucose-containing liquor was treated with ion exchange material in the bisulfite/-sulfite form and the treated liquor was contacted with immobilized glucose isomerase under glucose isomerizing conditions to convert a portion of the glucose in the liquor to fructose. The glucose-containing liquor preferably was one which had been ion-exchage refined.

Canadian Pat. No. 771,127 issued Nov. 7, 1967 to C. F. Boehringer Soehne provided a process for obtaining pure glucose and fructose from sucrose or from sucrose-containing invert sugars by passing an aqueous solution of sucrose or sucrose-containing invert sugar over an ion exchanger still containing between about 1 to about 30% of free acid groups.

Canadian Pat. No. 813,297 issued May 20, 1969 to Boehringer Mannheim GmbH provided a process for the production of invert sugar solutions from molasses, including the steps of first subjecting molasses to acidic hydrolysis at a pH of about 1–about 4, neutralizing the product with an aqueous basic solution or with a weak basic anion exchanger and subsequently separating the products chromatographically on a cation exchange resin solumn in the salt form.

Canadian Pat. No. 877,950 issued Aug. 10, 1971 to Corn Products Refining Company provided sweet syrup products by deanionization of the dextrose-bearing starting material prior to interconversion. Such deanionization removed the mineral anions (e.g. $Cl^-$, $SO_4^{--}$), normally present in the dextrose-bearing starting material and replaced them with $OH^-$ions. The deanionization also adjusted the pH of the material to the range said to be required for effective interconversion, i.e. about 8.50 to about 10. The deanionization was achieved by the use of a strongly basic anion exchanger or, by the use of an electrodialysis unit.

Canadian Pat. No. 918,150 issued Jan. 2, 1973 to Boehringer Mannheim GmbH provided a chromatographic process for the separation of carbohydrate solution containing glucose and fructose. In the patented process, a carbohydrate solution containing glucose and fructose was allowed to flow through a chromatographic column containing a separatory material adapted to fractionate the sugar into a glucose and a fructose fraction, by an eluting agent.

Canadian Pat. No. 963,899 issued Mar. 4, 1975 to Standard Brands Inc. provided a refined fructose-containing solution produced by an enzymatic process. In the patented process, an enzymatically-produced fructose-containing solution which contained color and color-forming bodies was treated with carbon to remove substantially the major portion of the color and color-forming bodies therefrom. The solution was maintained at an acidic pH, and was treated with a strong acid cation exchange resin in the hydrogen form and a weak base anion exchange resin in the free base form to remove substantially all the remaining color and color-forming bodies.

U.S. Pat. No. 2,746,889 issued May 22, 1956 to A. E. Staley Manufacturing Company described an interconversion process wherein the reaction was effected in the presence of a high basic ion exchange resin and an inert gas in order to deal with the problems of undesirable byproduct formation in the interconversion process. This patent, however, presented the problem of providing and maintaining an inert atmosphere. Moreover, it was characterized by an undesirable loss of dextrose by conversion to acid.

Dow Chemical Company, U.S. patent specification Nos. 3,044,904, 3,044,905 and 3,044,906, attempted to bring about the separation of glucose and fructose by column chromatography of an aqueous invert sugar solution over alkaline earth salts from cation exchangers, where the fructose is retained as opposed to the glucose. Both sugars could be obtained individually in successive eluate fractions. For example, U.S. Pat. No. 3,044,904 taught that glucose and fructose could be separated from aqueous solutions with a cation exchanger of the cross-linked sulphonated polystyrene type charged with calcium ions. Such process only gave good results when an approximately 50% sugar solution was allowed to run through a sufficiently long exchanger column at about 60° . To be operative, the starting material would have to be free from impurities, for example, inorganic salts. Therefore in the case of the known hydrolysis of sucrose with mineral acids, either the acid ions must be removed by an anion exchanger or the hydrolysis must be carried out in known manner with a cationic exchange resin in the H-form.

U.S. Pat. No. 3,285,776 issued Nov. 15, 1966 to Anheuser-Busch, Incorporated described an interconversion process employing alkali in the reaction, wherein the pH was continuously maintained within prescribed limits during the interconversion.

Other procedures proposed involved the enzymatic inversion to fructose. Since the issuance of the pioneer patent in this field, U.S. Pat. No. 2,950,228, granted to Richard O. Marshall on Aug. 23, 1960, there has been a great amount of activity in connection with enzymatic isomerization. Several different microbial sources of glucose isomerase enzyme preparations have been identified.

The conversion of glucose into syrups which contain glucose and fructose can be achieved by exploiting enzymes extracted from a number of micro-organism of the genera *Pseudomonas, Lactobacillus, Escherichica, Aerobacter, Bacillus* and others, e.g. *Aerobacter cloacas, Bacillus megaterium, Acetobacter suboxydans, Acetobacter malanogenus, Acetobacter roseus, Acetobacter oxydans, Bacillus fructosus* and *Lactobacillus formenti.* For the enzymatic isomerization of glucose into fructose, glucose isomerase (D-xylose-ketol-isomerase, 5.3.1.5) may be used to isomerize a solution of glucose, e.g., as corn syrup, under reaction conditions controlled in such a way that a fraction of glucose was converted into fructose, the amount of glucose which is converted into fructose being a function of an equilibrium constant which, at 60° C., is 1.

Thus, as taught by the prior art, starch may be first liquefied by an acid treatment and then saccharification be effected by enzymatic means; or both liquefaction and saccharification may be effected by enzymatic means.

The stability or effective life of immobilized glucose isomerase is probably influenced to the greatest extent by the quality of the substrate. The quality of glucose-containing liquors produced in the corn wet milling industry may be highly variable. Generally, these liquors are refined by conventional methods prior to isomerization. To attempt to avoid this problem, investigations have been carried out relating to the use of enzyme preparations in insoluble form, particularly with respect to the development of continuous isomerization processes.

The use of microbial and fungal enzymes adsorbed onto or bonded to inert carriers to provide immobilized biological catalysts is now prevalent. In general, immobilized enzymes provided a number of significant advantages over soluble or cell-bound enzymes particularly in commercial systems for carrying out continuous conversion processes. Pretreatments were also suggested to remove products which might inactivate enzymes. It has been found, however, that although such treatments provided some prolongation of the effective life of immobilized glucose isomerase, the stability of the enzyme is not as great as is desirable in continuous processes for isomerizing glucose to fructose.

Practicing such processes resulted in an enzymatically-produced fructose-containing solution which had minimal quantities of unwanted byproducts, color bodies and color-forming bodies.

There have been many patents directed to such enzymatic procedures. For example, U.S. Pat. Re. No. 28,885 to Cotter et al. provided an enzymatic method for isomerizing glucose syrups utilizing soluble glucose isomerase or cellular material containing this enzyme. Incorporation of a source of $SO_2$ into glucose-containing liquors during isomerization e.g. by soluble salts of sulfurous acids or by passing the liquor through ion exchange was taught to reduce denaturation of the glucose isomerase and to inhibit undesirable color formation in the finished product.

British Pat. No. 1,103,394 and Japanese Pat. No. 7428 (1966) to Takasaki et al. disclose that microorganisms classified as belonging to the *Streptomyces* genus, such as *Streptomyces flavorirons, Streptomyces achromogenes, Streptomyces echinatus* and *Streptomyces albus albus* produce glucose isomerase.

In Die Starke, 26 Jahrg., 1976/Nr. 10, pp. 350–356, Oestergaard et al. recommended that glucose-containing substrates be filtered and treated with carbon and ion-exchange materials prior to carrying out continuous isomerizations with glucose isomerase to remove impurities which may adversely affect the activity of the enzyme. They further disclosed that possibly harmful enzyme contaminants in the syrup, which apparently were formed during isomerization, may be protected against by utilizing a particular arrangement of a plurality of columns containing the immobilized glucose isomerase.

Canadian Pat. No. 986,866 issued Apr. 6, 1976 to CPC International Inc. provided a procedure for the isomerization of starch hydrolysates that contain glucose, to produce levulose-bearing products, by enzymatic isomerization, by the action of xylose isomerase (E.C. 5.3.1.5) enzyme preparation under non-oxidizing conditions. The glucose isomerase enzyme preparation was produced from a Streptomyces microorganism, for example, *S. olivochromogenes.*

Canadian Pat. No. 947,217 issued May 14, 1974 to Ken Hayashibara provided processes for the production of oligosaccharide mixtures having fructose molecules on their reducing ends (oligosyl fructose) by subjecting mixtures of starch, sucrose or fructose to the action of specific alpha-amylases thereby attaining simultaneous hydrolysis of starch and transfer of the formed oligosaccharides into sucrose or fructose.

Canadian Pat. No. 1,106,225 issued Aug. 4, 1981 to Snamprogetti provided a method for the production of fructose and syrups containing fructose and glucose by using an isomerizing enzyme obtained from microorganism of the Streptomyces genus. The patented involved contacting a solution of glucose with a microorganism selected from the group consisting of Streptomyces sp. genus NRRL 11.120 and NRRL 11.121 or with the enzyme originated thereby.

Canadian Pat. No. 1,117,047 issued Jan. 26, 1982 to CPC International Inc. provided a procedure for the enzymatic transfructosylation of sucrose by way of a fructose polymer-containing substrate. By the patented process a primary substrate, e.g., sucrose, was subjected to the action of a specified fructosyl transferase enzyme preparation.

As noted above, as a result of the above prior art discussion it is clear that fructose, a sugar of great sweetness and general utility, has hitherto been made only at high cost. It could also be made in small quantities by acid hydrolysis of plant polyfrucosans (e.g. inulin, found in Jerusalem artichokes, dahlias and certain other plants). It is known that inulin of the following structure, yields D-fructose and D-glucose by adding absolute alcohol to the syrup obtained from acid hydrolysis:

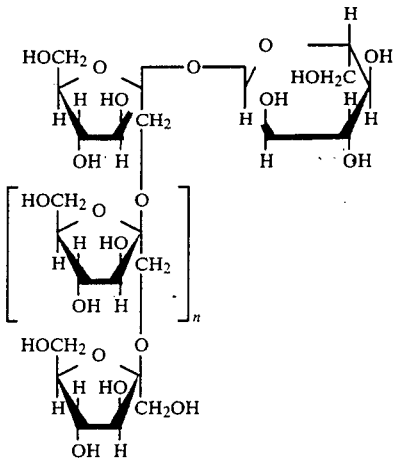

n = approx. 36

Some researches claim that a variety of physiological benefits can be obtained by including fructose in the diet. Thus, recent dietary experiments in Japan have shown two favourable effects of the fructooligosaccharides ($GF_{2-4}$) in humans. Five week administration of a glucose syrup containing the oligosaccharides to atherosclerosis patients resulted in a significant decline in blood cholesterol and blood pressure. Two week administration of the syrup to geriatric patients increased the population of a gut bacterium, Bifidobacterium, to the levels found in healthy younger humans (the decline in population of the bacterium has been associated with aging). Bifidobacterium grows well on these oligosaccharides (which are not digestible by humans) and produces lactic and acetic acids to lower the pH of the intestine. An increase in the intestinal pH has been associated with aging and is responsible for formation of nitrosamines which are potential carcinogens.

Because of these desirable physiological effects of the oligofructans, Meiji Seika Co. is manufacturing a "glucose" syrup containing these oligosaccharides produced by treating cane sugar (sucrose) in an immobilized fungal fructosyltransferase column. Its average composition is:

| | |
|---|---|
| Monosaccharide, largely glucose (G) | about 37% |
| Sucrose (GF) | about 11% |
| $GF_2$ | about 24% |
| $GF_3$ | about 23% |
| $GF_4$ | about 5% |

As glucose is less sweet than sucrose and $GF_{2-4}$ are much less sweet, the sweetness of such product is only about 60% of that of sucrose.

Despite the apparent recognition that an acceptable process for producing sweet syrups by interconversion would necessarily provide for the elimination or careful control of undesirable by-product and color formation, it appears that no practical solution has heretofore been developed.

Although the prior art methods have proven to be beneficial to a degree, continuous isomerization processes utilizing immobilized glucose isomerase have not hitherto been as efficient as desired due to the fact that the enzyme becomes inactivated after a relatively short period of use. Although the enzymatically-produced fructose-containing solutions produced by the methods described herein were relatively pure, it was nevertheless still necessary to refine the same in order to remove color, color-forming bodies and salts therefrom.

SUMMARY OF THE INVENTION (i) Aims of the Invention

It is therefore an object of the present invention to provide a practical process for interconverting inulin into fructose.

Another object of the present invention is to prepare a sweet syrup without formation of objectionable color bodies and without the development of objectionable flavor.

A further object of the present invention is to provide a process which does not require an inert atmosphere or alkali in the interconversion reaction.

A still further object of the present invention is to provide improved sweet syrups.

Yet another object of this invention is to provide a new and improved process for producing syrups containing fructooligosaccharide.

(ii) Statement of Invention

A process is provided by this invention for the preparation of syrups containing fructooligosaccharides by the hydrolysis of inulin, which process comprises the steps of: (a) providing an aqueous solution containing inulin (b) passing warm such aqueous solution at a temperature of about 40° C. to about 70° C. through a column containing a strong acid cation-exchange resin, thereby providing an effluent having a pH of about 2.0–about 3.0; (c) hydrolyzing the effluent by heating at a temperature of about 70–about 100° C.; (d) passing the hydrolyzate through a column containing a weak base anion-exchange resin, thereby providing an effluent having a pH of about 6.5–about 7.0; and (e) concentrating the effluent to a syrup containing less water than the effluent.

The practice of the process of the present invention provides a fructose-containing syrup having a solids content of about 40–about 70% by weight of which about 0–about 100% by weight comprises monosaccharides and, corresponding about 100–about 0% by weight comprises fructooligosaccharides.

(iii) Features of the Invention

By a feature of the process of this invention, the aqueous solution containing inulin is derived from Jerusalem artichoke tubers or chicory root.

By another feature of the process of this invention, the aqueous solution contains about 5–about 10% by weight inulin.

By yet another feature of the process of this invention, the inulin solution is obtained by heating comminuted Jerusalem artichoke tubers or chicory roots in water at about 80°–about 100° C. for about 20–about 30 minutes.

By still another feature of the process of this invention, the aqueous solution containing inulin is recovered by pressing and filtering a hot aqueous pulp mixture of the comminuted tubers or roots.

By yet another feature of the process of this invention, the warm aqueous solution of inulin is at a temperature of about 40°–about 70° C.

By still another feature of the process of this invention, the cation-exchange resin is the $H^+$ form of a sulfonic acid resin.

By a further feature of the process of this invention, the pH of the effluent from the cation-exchange resin column is adjusted to about 2.0–about 2.5, e.g. by HCl or $H_2SO_4$ if necessary.

By yet a further feature of the process of this invention, if the pH is about 2.5, a partial hydrolysis is achieved at a temperature of about 100° C. for a time of about 2.5 minutes.

By still another feature of the process of this invention, if the pH is about 2.5, a partial hydrolysis is achieved at a temperature of about 100° C. for a time of about 5.0 minutes.

By yet another feature of the process of this invention, if the pH is about 2.5, a substantially complete hydrolysis is achieved at a temperature of about 100° C. for a time of about 15.0 minutes.

By yet a further feature of the process of this invention, the hot hydrolyzate is treated with an activated or granular charcoal prior to passage through the column containing the weak base anion-exchange resin.

By still a further feature of the process of this invention, the anion-exchange resin is the $OH^-$ form of a microporous weak base anion exchanger.

By yet a further feature of the process of this invention, the concentration is carried out to provide a syrup containing about 40–about 70% by weight of solids.

By a still further feature of the process of this invention, the concentration is carried out to provide a syrup containing about 70% by weight solids.

By another feature of the process of this invention, the concentration may be effected by means of vacuum evaporation, or means of reverse osmosis or by means of reverse osmosis followed by evaporation.

By another feature of the process of this invention, the heating is preferably effected by passing the effluent through a coiled tubing maintained at the temperature of about 70–about 100° C., in order to provide a more energy effluent system.

By carrying out the process of preferred features of this invention syrups having, the following compositions in % by weight are provided: Glucose about 4.6, Fructose about 16.4, $F_2$ about 44.9, $F_3$ about 11.9, $F_4$ about 6.0, Others about 7.6; or Glucose about 7.2, Fructose about 26.2, $F_2$ about 38.1, $F_3$ about 8.1, $F_4$ about 6.6, $F_5$ about 4.6, Others about 9.3; or Glucose about 13.5, Fructose about 45.1, $F_2$ about 36.7, $F_3$ about 3.3, $F_4$ about 1.6, $F_5$ about 0.6, Others 0; or Glucose about 22.1, Fructose about 63.8, $F_2$ about 12.1, $F_3O$, $F_4O$, $F_5O$, Others about 2.0.

(iv) Generalized Description of the Invention

The syrup produced by carrying out the process of this invention, as produced from the partial or substantially complete hydrolysis of inulin from, e.g., Jerusalem artichoke tubers, has a high content of fructose and fructooligomers and a low content of glucose. The syrup is sweeter than prior art syrups and can be used as a sweetener for diabetics. Because of the low sucrose content, the syrup would be less cariogenic than previous syrups.

Jerusalem artichoke, a native plant of Canada, grows well in colder climates (even in waste lands) and produces a high yield of inulin in its tuber (one hectare produces up to about 8 tons of inulin). Inulin as described above is a polysaccharide which consists of 2 to 35 fructose (F) units with a terminal glucose (G), and may be abbreviated $GF_{2\text{-}35}$.

Fructose-containing polymers, $1^F(1\text{-}\beta\text{-fructofuranosyl})_{n-1}$ sucrose (abbrevaited GFn), are widely present in plant materials. The fructooligosaccharides ($GF_{2\text{-}4}$) are present in many vegetable foods, e.g. asparagus, lettuce, onion and oatmeal. As noted above, the polysaccharides consisting of a high as 35 fructose units ($GF_{35}$) are called inulin. The tubers or roots of Jerusalem artichoke, chicory and dahlia are rich in inulin. The Jerusalem artichoke tubers have been eaten as a vegetable, even though inulin is tasteless and cannot be digested by humans.

Jerusalem artichoke tubers can be efficiently produced and harvested in late October and ideally should be processed within a few months (inulin content declines with storage time). While inulin from Jerusalem artichoke tubers is the preferred source according to aspects of this invention, the inulin may also be derived, in a similar fashion, from the roots of chicory or dahlia.

BRIEF DESCRIPTION OF THE DRAWINGS

In the accompanying drawings.

DESCRIPTION OF PREFERRED EMBODIMENTS (i) Examples

Figure 1:
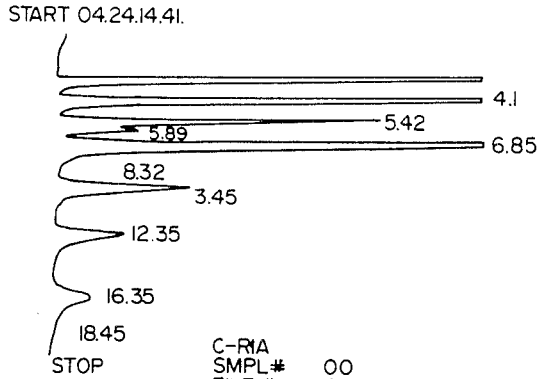
FIGS. 1–4 are print-outs of the spectrographic analyses of syrups of four embodiments of this invention.

The following are Examples of the process of the present invention:

GENERAL EXAMPLE 1

Production of Fructose Syrup and Fructose Syrup Containing Fructooliogosaccharides from Jerusalem artichoke tubers or Chicory root Step 1

Tubers or roots are washed, sliced and mixed with an equal weight of water and heated, e.g. to about 80°–about 100° C. for, e.g. about 20–about 30 min. The juice is collected, e.g. by press and filter. (The juice contains, e.g. about 5–about 10% inulin, and inulin of high molecular weights precipitates on cooling).

Step 2

The juice, while warm (e.g. about 40°–about 70° C.), is passed through a column of strong acid cation exchanger resin ($H^+$) e.g. that known by the Trade Mark DOWEX 88. The pH of the effluent is e.g. between about 2 and about 3. The pH is adjusted to within the range of about 2.0–about 2.5 with HCl or $H_2SO_4$.

Step 3

Inulin is hydrolyzed to various degrees by heating at a temperature between about 70–about 100° C. for various periods of time. This can be accomplished for example by passing, at various flow rates the above liquid through two spirally coiled tubings (e.g. glass tubing at 4 mm O.D., 2.5 mm I.D. and about 24 feet length, having about 32 ml capacity) which is embedded in an electrically heated incubator. If the liquid has been adjusted to pH of about 2.5, and heated at about 100° C., a residence time of about 2.5 minutes yields a syrup of about 20% monosaccharides (largely fructose) and about 80% fructooligosaccharides; a residence time of about 5.0 minutes, yields a syrup of about 50–about 50 mixture; and a residence time of about 15 minutes yields about 100% monosaccharides (substantially complete hydrolysis).

Step 4

After hydrolysis, the liquid is cooled to room temperature and passed through a filter, e.g. that known by the trade name Whatman glass fibre filter GF/A. The filter can be reused after washing with, e.g. dilute NaOH and water.

Step 5

Decolorization can be accomplished by either (i) charcoal powder or (ii) granular charcoal.

(i) The filtrate (100 Parts) is mixed with 1 part of activated charcoal powder, e.g. that known by the Trade mark NORIT SX 2, and then passed through a press filter. or (ii) The filtrate is passed through a column of activated granular charcoal e.g. that known by the Trade Mark NORIT ROX 0.8 which has been prewashed with water to remove fines. If charcoal fines are present in the eluate, they can be removed by filtration through a fine filter, e.g. that known by the trade name Whatman glass fibre filter GF/F or cellulose acetate or nitrate membrane filter (0.45μ).

Step 6

The liquid is passed through a column of macroporous weak gase anion exchanger resin ($OH^-$) e.g. that known by the trade mark DOWEX 66. The pH of the liquid rises to e.g. about 6.5–about 7.0.

Step 7

The liquid is concentrated to syrup of e.g. about 40–70% by weight solid either by evaporation alone or by a combination of reverse osmosis followed by evaporation.

Analysis of four syrups produced by the above described hydrolysis of inulin give the following results:

| SAMPLE | GLUCOSE | FRUCTOSE | F2 | F3 | F4 | F5 | Others | Total |
|---|---|---|---|---|---|---|---|---|
| A | 4.6 | 16.4 | 44.9 | 11.9 | 8.6 | 6.0 | 7.6 | 100.1 |
| B | 7.2 | 26.2 | 38.1 | 8.1 | 6.6 | 4.6 | 9.3 | 100.0 |
| C | 13.5 | 45.1 | 36.7 | 3.3 | 1.6 | 0.6 | 0 | 100.8 |
| D | 22.1 | 63.8 | 12.1 | — | — | — | 2.0 | 100.0 |

Figure 2:
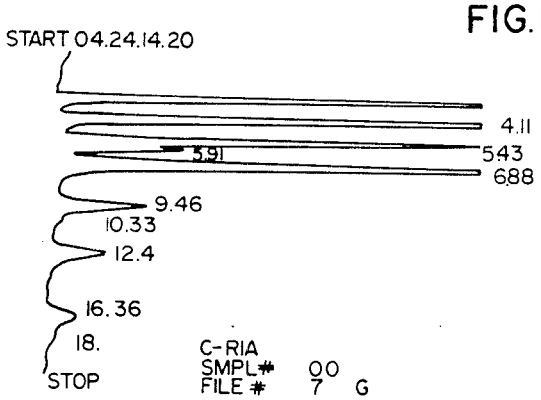
Figure 3:
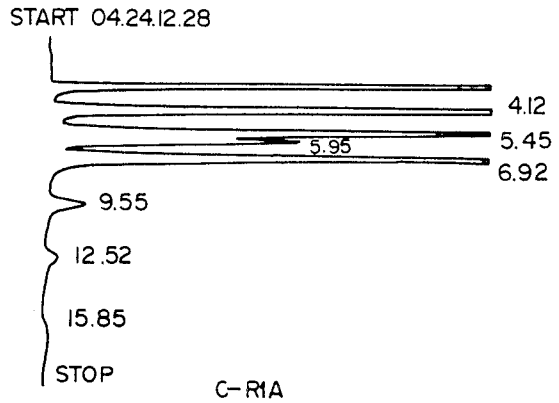
Figure 4:
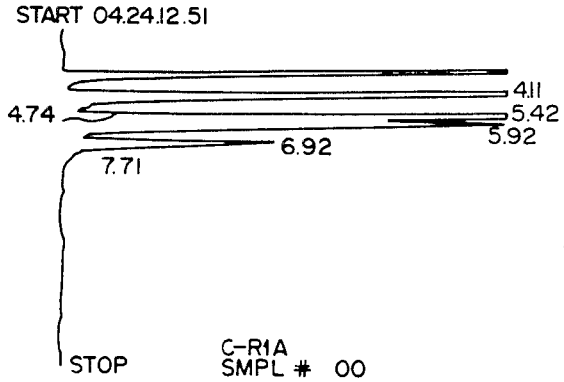

As described above, the print-outs of the spectographic analysis of these four syrups are shown in FIGS. 1–4 respectively.

(ii) Description of Alternative Embodiments

The preferred strong acid cationic exchange resin used in Step 2, above is the sulfonic acid cationic exchanger known by the trade mark DOWEX 88. Other cationic exchangers which may be used are those known by the Trade Marks DOW 2X8, DOW 21R, DOWEX 50 WX4 AMBERLITE IR, AMBERLITE 401, or PERMUTIT MP600.

The removal of anions in step 6 is preferably achieved with a macroporous weak anion exchange resin, that known by the Trade Mark DOWEX 66. Other resins of the weak base type include the following: those known by the Trade Marks DUOLITE A-6, DUOLITE A-7, DUOLITE A 30B and DUOLITE ES-561 (of Diamond Shamrock); IONAC A-300 (of Ionac); and AMBERLITE IRA 68, IRA 475 and IRA-93 (of Amberlite).

Other typical resins usable according to the invention are the sulphonated polystyrene resins cross-linked with divinylbenzene, examples of which are those known under the Trade Marks DOWEX 50 W, ZEO KARB 225 and AMBERLITE 252. Resins having a low-cross-linkage content (e.g. about 1% divinylbenzene by weight) and having a high cross-linkage content (e.g. about 12% divinylbenzene by weight) are less effective than those having intermediate cross-linkage content (about 2% to about 8% divinylbenzene by weight). Usuable resins generally have a particle size in mesh range about 20–about 100.

Other usuable resins are those in which the matrix is principally composed of polystryene and which have a relatively low degree of crosslinking. A sulfonated polystyrene resin having a relatively low degree of cross-linking (2-6) may also be used as the ion exchanger.

Other anion exchange resins may also be used. Examples include the aldehyde condensation products of m-phenylene diamine, biguanide, guanyl urea, substituted guanidines, e.g. methyl guanidine; substituted biguanides, e.g. phenyl biguanide; and polyamines, preferably the polyethylene polyamines, etc. Such condensation products which are preferably formaldehyde condensation products may be used if desired. Examples of other aldehydes are furfural, acrolein, benzaldehyde, etc. The active resins, e.g. those prepared from guanidine, guanyl urea, biguanide and other materials which do not form sufficiently insoluble condensation products with formaldehyde for most practical purposes, are preferably insolubilized with suitable formaldehyde reactive materials, e.g. urea, thioureas, the aminotriazines (especially melamine and the guanamines which react with formaldehyde to produce insoluble products), etc. Usually it is convenient to use salts of the bases, but the free bases may also be used. Examples of suitable salts for use in the preparation of anion active resins are guanidine carbonate, guanidine sulfate, guanyl urea carbonate, etc.

The anion active resins are activated in the conventional manner by treatment with a dilute solution of an alkali, e.g. a solution of sodium hydroxide, sodium carbonate, the corresponding potassium salts, etc. of a concentration of about 0.1 - about 10%. The hydroxides are however, much more effective in regenerating resins for use in accordance with this invention.

The process of this invention also preferably includes, as a fourth step, a decolorizing step using an activated charcoal powder, e.g. that known by the Trade Mark NORIT 5X2. Other decolorizing agents include bone black, diatomaceous earth, bauxite, or decolorizing charcoal of the admixtures of granular activated carbon and bone char provided by Canadian Pat. No. 1,133,881 issued to Calgon Corporation. Examples of such mixtures include an admixture of bone char and granular activated carbon in which greater than 10 percent by weight of activated carbon is employed, but the mixture may be comprised of activated carbon composition from about 10 percent to about 50 percent by weight. The most preferred compositions include from about 10 percent to about 30 percent by weight activated carbon. The remainder of the composition consists essentially of bone char.

The granulated activated carbon, like the bone char employed, is suitably 8×50 mesh and preferably an 8×35 mesh. By that term, it is meant that from 0 percent to about 5 percent by weight of the granular material is retained by the larger U.S. Standard Sieve, and from 0 percent to about 5 percent by weight is passed by the smaller sieve of the range.

ADVANTAGES AND USES OF THE PRESENT INVENTION

According to the present invention, a sweet "fructose" syrup containing these oligofructans has been provided by partial hydrolysis of inulin. Inulin hydrolysis employed in the present process is catalyzed by protons ($H^+$) generated from a cation exchanger ($H^+$form) during removal of cations present in the Jerusalem artichoke juice. $H^+$-catalyzed hydrolysis is much less expensive. This chemical production process is simpler, more efficient, and less costly than enzymic methods. Such a syrup can be used as truly "health" sweetener, particularly ideal for elderly people and diabetics. The tuber pulp obtained after juice extraction is rich in protein and can be used as feed. Cation and anion exchangers used can be readily regenerated by HCl and NaOH, respectively and reused.

This syrup also has the properties of the conventional sugars and syrups and may be employed in its customary applications. These include, for example, use as food sweetening agents and as raw materials for the preparation of pharmaceuticals. In addition, these products may be employed in the common industrial applications for sugars and syrups.

In a number of uses, the fructose-containing syrups of aspects of the present invention provide benefits which could not be achieved by the use of conventional glucose syrups, invert syrups, sucrose syrups, or sucrose. For example, in many applications corn syrups and sucrose are used together to provide a dual sweetening system to obtain the particular functional advanrage of corn syrup and the sweetening power of the sucrose. Since the fructose-containing syrups of aspects of the present invention are generally very sweet, such solutions can replace the dual sweetening system. For the user, a single sweetening system, like the fructose-containing syrups of aspects of the present invention, is easier to handle and store. This, of course, provides obvious economic benefits. Furthermore, when sucrose is used in many products, inversion takes place which results in the sweetness of the product varying on storage, i.e., sweetness will vary as more sucrose is inverted. This is especially true in products which are acidic or which produce acidic bodies on storage. Such varying of the sweetness will not occur with the fructose-containing syrup of aspects of the present invention.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A process for the preparation of syrups containing fructooligosaccharides by the hydrolysis of inulin which process comprises the steps of:

(a) providing an aqueous solution containing inulin;

(b) passing warm said aqueous solution at a temperature of about 40° C. to about 70° C. through a column containing a strong acid cation-exchange resin, thereby providing an effluent having a pH of about 2.0–about 3.0;

(c) hydrolyzing said effluent by heating at a temperature of about 70° C.–about 100° C.;

(d) passing said hydrolyzate through a column containing a weak base anion-exchange resin, thereby providing an effluent having a pH of about 6.5–about 7.0; and (e) concentrating said effluent to a syrup containing less water than said effluent.

2. The process of claim 1, wherein said aqueous solution containing inulin is derived from Jerusalem artichoke tubers or chicory root.

3. The process of claim 1 wherein said aqueous solution contains about 5–about 10% by weight inulin.

4. The process of claim 1, wherein said inulin solution is obtained by heating comminuted Jerusalem artichoke tubers or chicory root in water at about 80°–about 100° C. for about 20–about 30 minutes.

5. The process of claim 4 wherein said aqueous solution containing inulin is recovered by pressing and filtering a hot aqueous pulp mixture of said comminuted tubers or roots.

6. The process of claim 1, wherein said cation-exchange resin is the $H^+$ form of a sulfonic acid resin.

7. The process of claim 6, wherein the pH of the effluent from the cation-exchange resin column is adjusted to about 2.0–about 2.5.

8. The process of claim 7, wherein said pH adjustment is achieved with HCl or $H_2SO_4$.

9. The process of claim 7, wherein said hydrolyzing takes place to provide a partial hydrolysis and is achieved at a temperature of about 100° C. for a time of about 2.5 minutes.

10. The process of claim 7, wherein a partial hydrolysis is achieved at a temperature of about 100° C. for a time of about 5.0 minutes.

11. The process of claim 7, wherein a substantially complete hydrolysis is achieved at a temperature of about 100° C. for a time of about 15.0 minutes.

12. The process of claim 1 wherein said hydrolyzate at a temperature of about 70°C.–about 100° C. is treated with an activated or granular charcoal prior to passage through said column containing said weak base anion-exchange resin.

13. The process of claim 1 wherein said anion-exchange is the $OH^-$ form of a microporous weak base anion exchanger.

14. The process of claim 13 wherein said concentration is carried out to provide a syrup containing about 70% by weight of solids.

15. The process of claim 1 wherein said concentration is carried out to provide a syrup containing about 40–about 70% by weight solids.

16. The process of claim 1 wherein said concentration is effected by means of evaporation.

17. The process of claim 1 wherein said concentration is effected by means of reverse osmosis.

18. The process of claim 1 wherein said concentration is effected by reverse osmosis followed by evaporation.

19. The process of claim 1 wherein said heating is carried out by passing said effluent through a coiled tubing maintained at said temperature of about 70–about 100° C.

* * * * *